US007371045B2

(12) United States Patent
Patel et al.

(10) Patent No.: US 7,371,045 B2
(45) Date of Patent: May 13, 2008

(54) PUMP APPARATUS AND METHOD

(75) Inventors: Anil B. Patel, La Crescenta, CA (US); Humberto V. Meza, Tustin, CA (US)

(73) Assignee: SHURflo, LLC, Cypress, CA (US)

( * ) Notice: Subject to any disclaimer, the term of this patent is extended or adjusted under 35 U.S.C. 154(b) by 5 days.

(21) Appl. No.: 11/255,168

(22) Filed: Oct. 19, 2005

(65) Prior Publication Data

US 2007/0086888 A1 Apr. 19, 2007

(51) Int. Cl.
*F04D 29/58* (2006.01)

(52) U.S. Cl. ..... 415/175; 415/177; 415/178; 415/206

(58) Field of Classification Search ..... 415/121.2, 415/175, 176, 177, 178, 179, 180, 203, 204, 415/206

See application file for complete search history.

(56) References Cited

U.S. PATENT DOCUMENTS

| | | | | |
|---|---|---|---|---|
| 3,304,875 | A * | 2/1967 | Copeland | 417/423.14 |
| 3,417,704 | A * | 12/1968 | Pall et al. | 417/357 |
| 3,520,642 | A * | 7/1970 | Fulton | 417/420 |
| 3,667,870 | A * | 6/1972 | Yoshida et al. | 415/160 |
| 5,238,363 | A * | 8/1993 | Thielke et al. | 415/121.2 |
| 6,034,465 | A * | 3/2000 | McKee et al. | 417/352 |
| 6,551,058 | B2 * | 4/2003 | Nowack | 415/140 |

* cited by examiner

*Primary Examiner*—Igor Kershteyn
(74) *Attorney, Agent, or Firm*—Greenberg Traurig, LLP

(57) ABSTRACT

A pump including a pump housing, a fluid inlet, a fluid outlet, a pumping chamber in fluid communication with both the fluid inlet and the fluid outlet, a motor for pumping a working fluid, and a plate that is at least partially constructed of a heat conductive material and that at least partially defines the pumping chamber. The plate can transfer heat from the motor to the working fluid in the pumping chamber.

30 Claims, 7 Drawing Sheets

PUMP APPARATUS AND METHOD

FIELD OF THE INVENTION

The invention relates to pumps, such as bilge pumps and bait/live-well pumps. More specifically, embodiments of the invention relate to cooling electric motors of pumps, particularly under high-flow or prolonged-use conditions.

BACKGROUND OF THE INVENTION

Conventional bilge and bait/live-well pumps include compact electric motors that drive an impeller and pump water from one location to another. The motors in pumps are typically permanent magnet electric motors which operate on 12 Volt, 24 Volt, or 32 Volt DC power. Upon operating at high load or over an extended period of time, pump motors produce a significant amount of heat, which can affect the efficiency of the motor or, at the extreme, damage the coils of the motor and disable it completely. Proper cooling must be taken into consideration when designing pumps.

Most commonly, bilge and bait/live-well pumps are constructed mainly of plastic, which is a good temperature insulator. This is detrimental to an electric motor that needs to dissipate heat to maintain acceptable performance. This problem has been addressed in the past by providing cooling paths within a plastic pump housing to route water directly to a portion of the motor. However, the motor contains many parts which cannot be submersed in water and must be sealed from the cooling paths, which adds cost and complexity to the design of the pump.

SUMMARY OF THE INVENTION

In one embodiment, a pump for pumping a working fluid is provided. The pump can include a pump housing defining a fluid inlet and a fluid outlet, both of which communicate with a pumping chamber. The pump can include an impeller positioned in the pumping chamber. A motor with a rotary output shaft can be coupled to the impeller. A plate at least partially constructed of a heat conductive material can at least partially define the pumping chamber. The plate can transfer heat from the motor to the working fluid in the pumping chamber.

In one embodiment, a pump can include a pump housing, a fluid inlet, a fluid outlet, a pumping chamber in fluid communication with both the fluid inlet and the fluid outlet, and a motor for pumping a working fluid. The pump can include a plate at least partially constructed of a heat conductive material. The plate can at least partially define the pumping chamber and can transfer heat from the motor to the working fluid in the pumping chamber.

In one embodiment, a method of removing heat from the motor of a pump for pumping a working fluid is provided. The method can include pumping the working fluid through a pumping chamber with a rotating impeller, conducting heat from the motor to a plate, and transferring heat from the plate to the working fluid in the pumping chamber.

Other aspects of the invention will become apparent by consideration of the detailed description and accompanying drawings.

DETAILED DESCRIPTION OF THE INVENTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
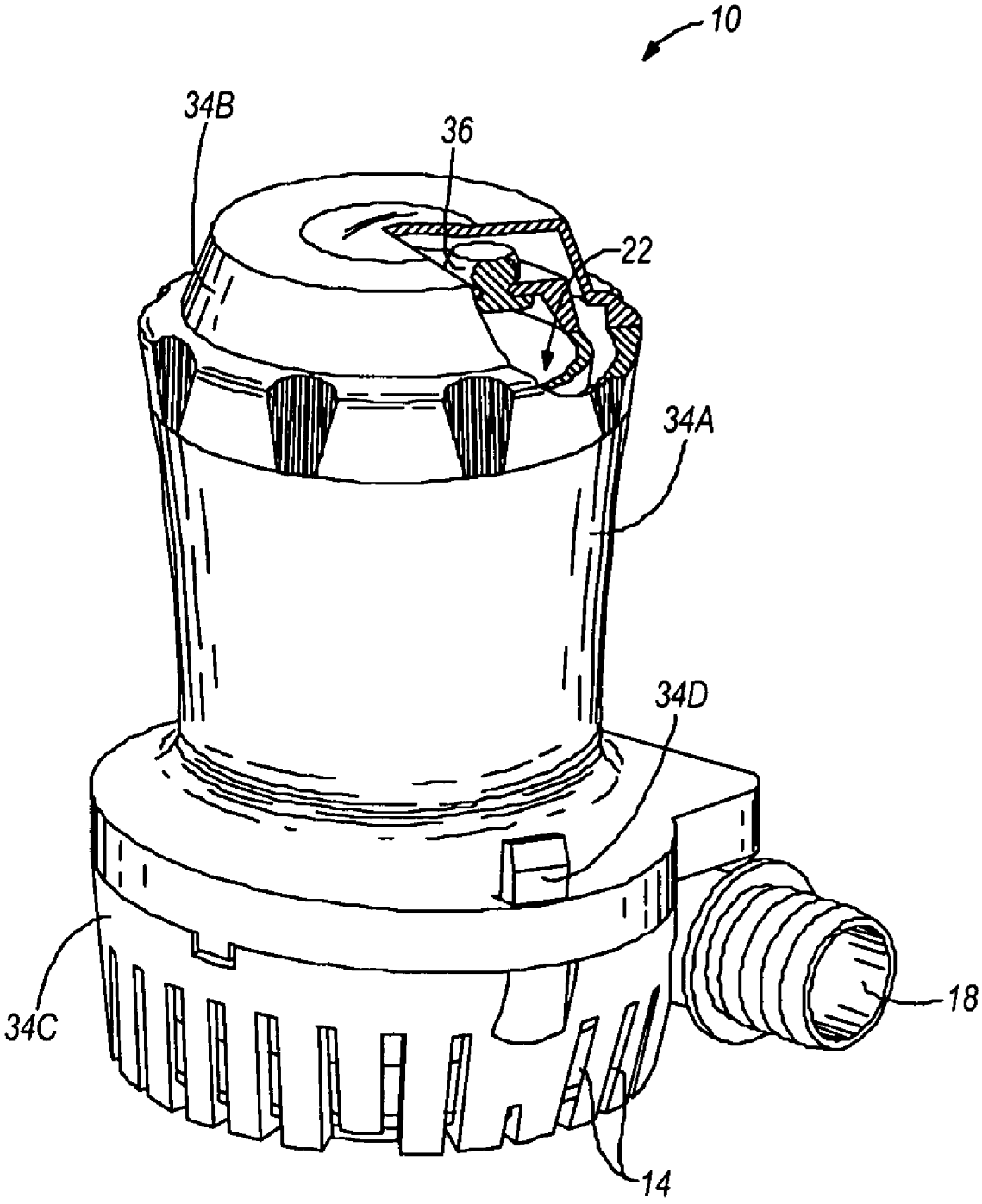
FIG. 1 is a perspective view of a pump according to one embodiment of the invention.
Figure 2:
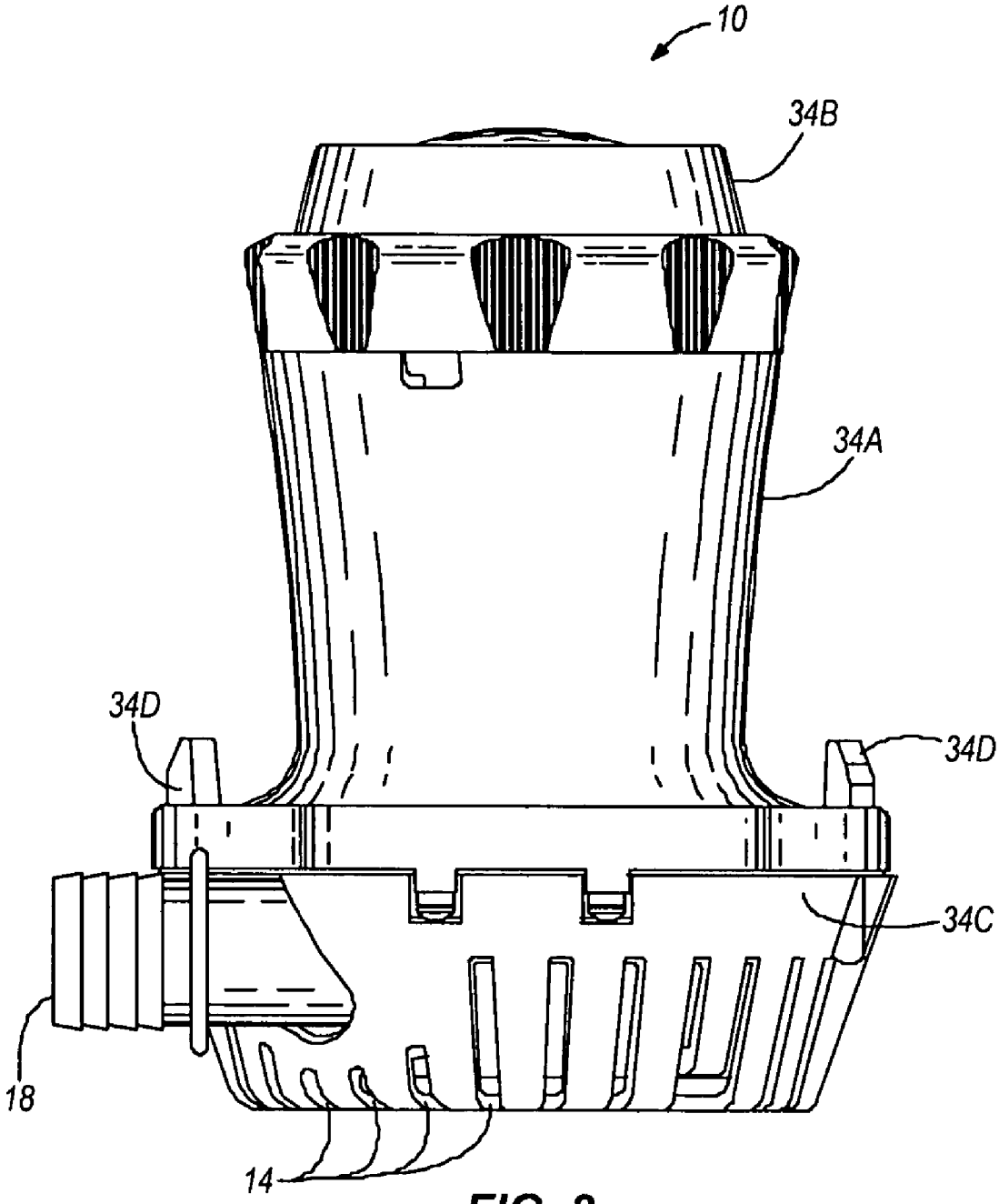
FIG. 2 is a front view of the pump of FIG. 1.
Figure 3:
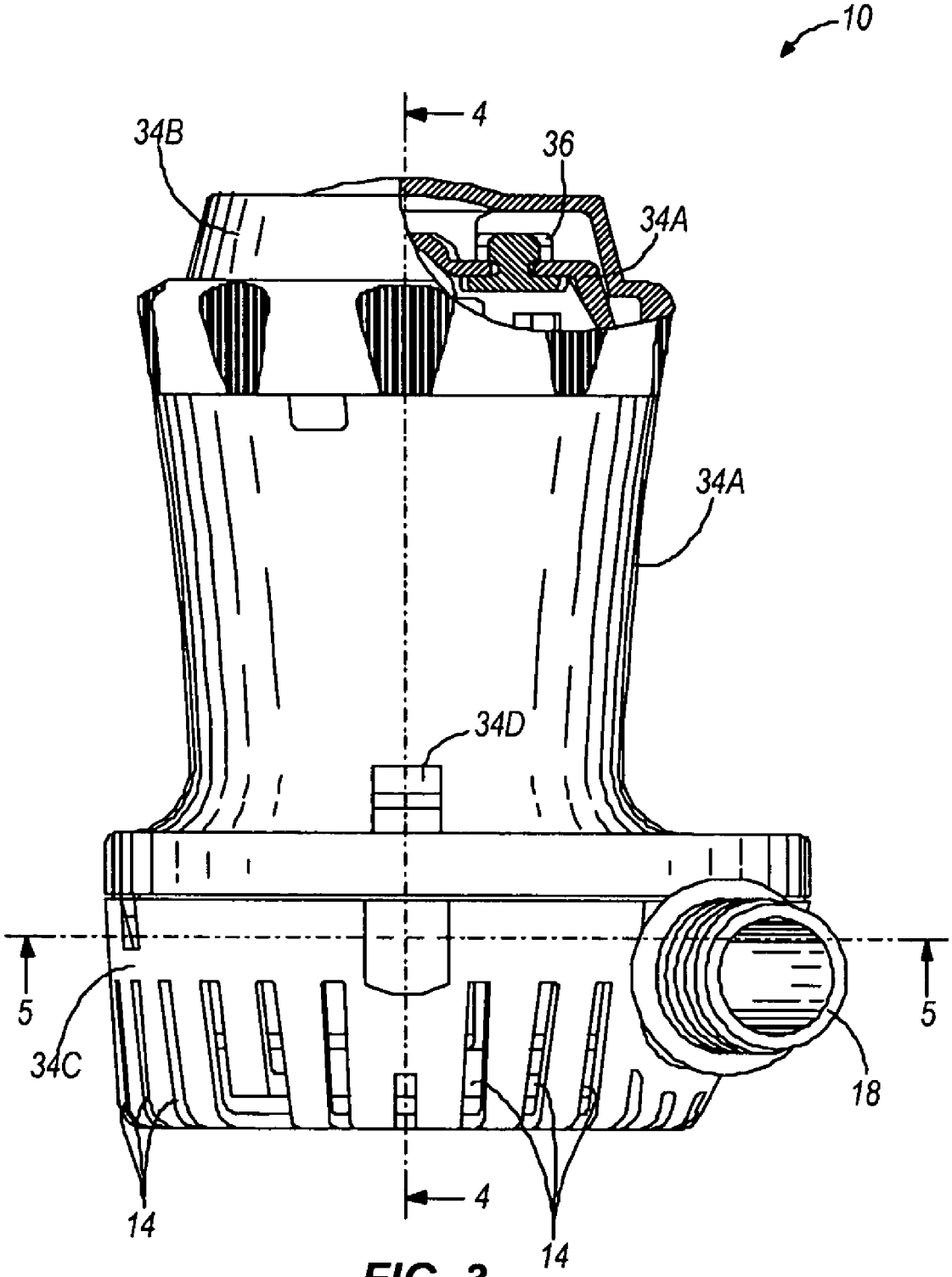
FIG. 3 is a side view of the pump of FIG. 1.
Figure 4:
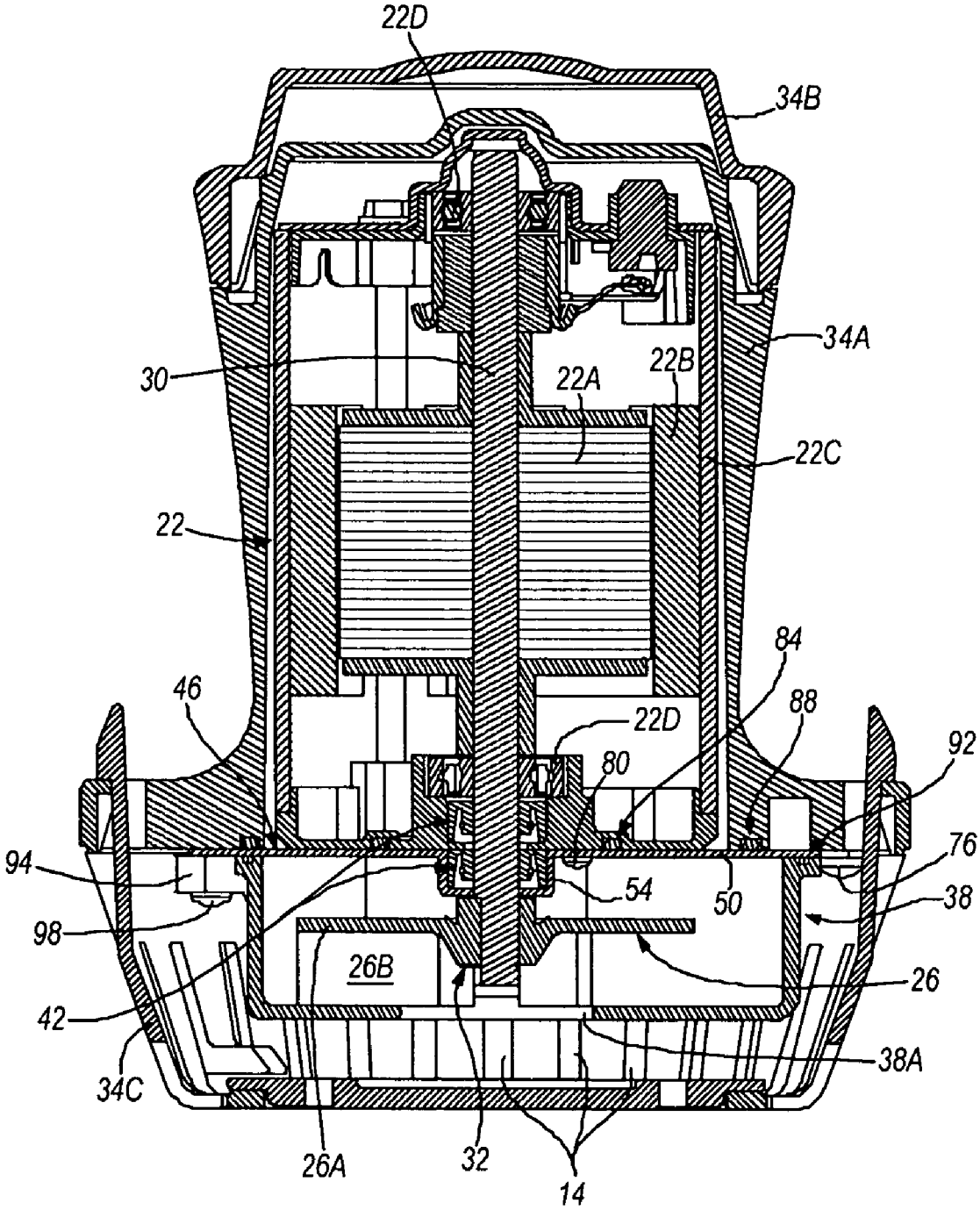
FIG. 4 is a section view of the pump taken along line A-A (shown in FIG. 3)

FIGS. 1-5 illustrate a pump 10 according to one embodiment of the invention. The pump 10 can be used as a bilge pump, a bait/live-well pump, or in other suitable environments. The working fluid pumped by the pump 10 can be fresh water, salt water, filtered water, unfiltered water, fuel, or other liquids. Bait/live-well pumps are generally continuous-duty pumps. The pump 10 can include a fluid inlet 14 and a fluid outlet 18. The pump 10 can be powered by a motor 22, internal to the pump 10, which can drive an impeller 26 via a driveshaft 30, as shown in FIG. 4. The impeller 26 can be coupled to the driveshaft 30 by a retaining ring 32, or can be formed integrally with the driveshaft 30 in other embodiments. The motor 22 can be a 12 Volt, 24 Volt, or 32 Volt DC motor, but DC motors of various voltages and other power sources with rotary output may also be used with the pump 10. The pump 10 can include a housing 34, which can be constructed of plastic and can include a generally cylindrical body 34A, an upper cap 34B, and a base 34C. The base 34C can include resilient tabs 34D, which engage the body 34A and mount the base 34C to the body 34A, as shown in FIGS. 1-3. The motor 22 can be positioned within the body 34A. As shown in FIGS. 1 and 3, a wire grommet 36 coupled to the body 34A can allow electrical wires to pass from the motor 22 to the outside of the body 34A. As shown in FIG. 4, an impeller shroud 38, can surround the impeller 26, and can define a pumping chamber. The impeller shroud 38 can include a pumping chamber inlet 38A, which can receive working fluid from the fluid inlet 14 of the pump 10. In some embodiments, the fluid inlet 14 of the pump 10 can be formed in the base 34C. The fluid outlet 18 of the pump 10 can be formed as part of the impeller shroud 38 and can extend substantially tangentially from the circumference of the impeller shroud 38.

As shown in FIG. 4, the motor 22 can include a rotor 22A and a magnet 22B. The rotor 22A can be coupled to the impeller 26. The motor 22 can be positioned within a motor housing 22C, which can fit with little or no clearance inside the body 34A of the pump housing 34. When the motor 22 is energized, the rotor 22A can rotate relative to the magnet 22B and motor housing 22C about an axis running along the length and through the center of the motor housing 22C. The impeller 26 can move fluid within the pumping chamber. The motor 22 can include bearings 22D between the motor housing 22C and driveshaft 30 to allow the driveshaft 30 to rotate without significant resistance and to locate and align the driveshaft 30 relative to the motor housing 22C.

The end of the pump 10 containing the impeller 26 and the pumping chamber is referred to herein as the "lower end." The use of the words "lower," "upper," "above," "below," etc., in the detailed description is used for reference only and should not be considered limiting. The lower bearing 22D can be accompanied by shaft seals 42 surrounding the driveshaft 30 and positioned between the impeller 26 and the lower bearing 22D. In some embodiments, multiple shaft seals 42 can be used to ensure no leakage of the working fluid from the pumping chamber into the motor housing 22C along the driveshaft 30. Many types of shaft seals in any suitable quantity can be used.

As shown in FIGS. 5-8, the plate 46 can include a planar portion 50 and a boss 54 extending from the planar portion 50. The planar portion 50 can include two mounting ears 58, each having a mounting hole 62 for mounting the plate within the pump 10. The planar portion 50 can have a uniform or varying thickness T between an upper surface 50A and a lower surface 50B. The boss 54 can be cylindrical in shape and can extend from the planar portion 50, terminating at a recessed wall 64, which can lie substantially parallel with the planar portion 50. The recessed wall 64 can include an upper surface 64A and a lower surface 64B, where the upper surface 64A is internal to the boss 54, which can be hollow. The interior of the boss 54 can also include a seal retaining bore 68 having a cylindrical inner surface and forming a retaining bore. The cylindrical shape of the seal retaining bore 68 can correspond to the cylindrical shape of the boss 54. The boss 54 and the seal retaining bore 68 can also be constructed in different shapes. In one embodiment, three mounting holes 72 in the planar portion 50 can allow the plate 46 to be coupled to the motor 22. A bore 70 through the recessed wall 64 can allow the driveshaft 30 to pass through the plate 46.

As shown in FIG. 4, the lower shaft seal 42 can be encased by the seal retaining bore 68 of the plate 46. The plate 46 can be positioned between the body 34A and the impeller shroud 38 and can be held in place by fasteners 76, which can pass through the mounting holes 62. The motor 22 can be mounted to the plate 46 via fasteners 80, which can pass from the lower surface 50B of the planar portion 50 into threaded bores in the motor housing 22C, aligned with the mounting holes 72. The fasteners 76 and 80 can attach the plate 46 to the body 34A and the motor housing 22C, respectively, to secure the motor 22 within the body 34A. O-rings 84, 88 can be positioned between the plate 46 and the motor housing 22C and the body 34A, respectively. The O-rings 84, 88 can prevent the working fluid from entering the body 34A when the pump 10 is submersed. A gasket 92 can be positioned between the plate 46 and the impeller shroud 38 to create a sealed periphery around the impeller shroud 38. The gasket 92 can prevent flow of the working fluid into or out of the pumping chamber, except at the fluid outlet 18 and the pumping chamber inlet 38A.

Figure 5:
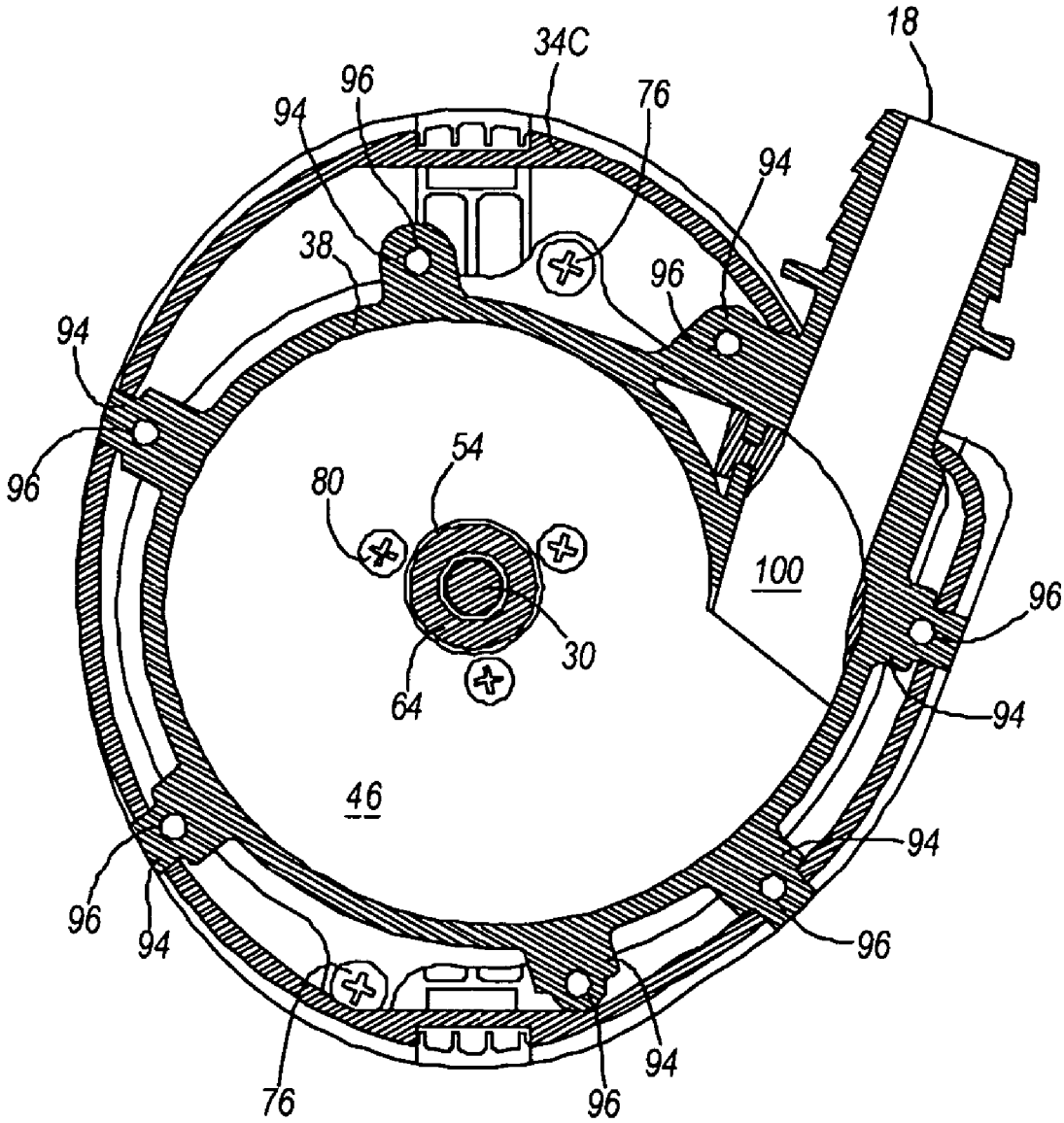
FIG. 5 is a section view of the pump taken along line B-B (shown in FIG. 3)
Figure 6:
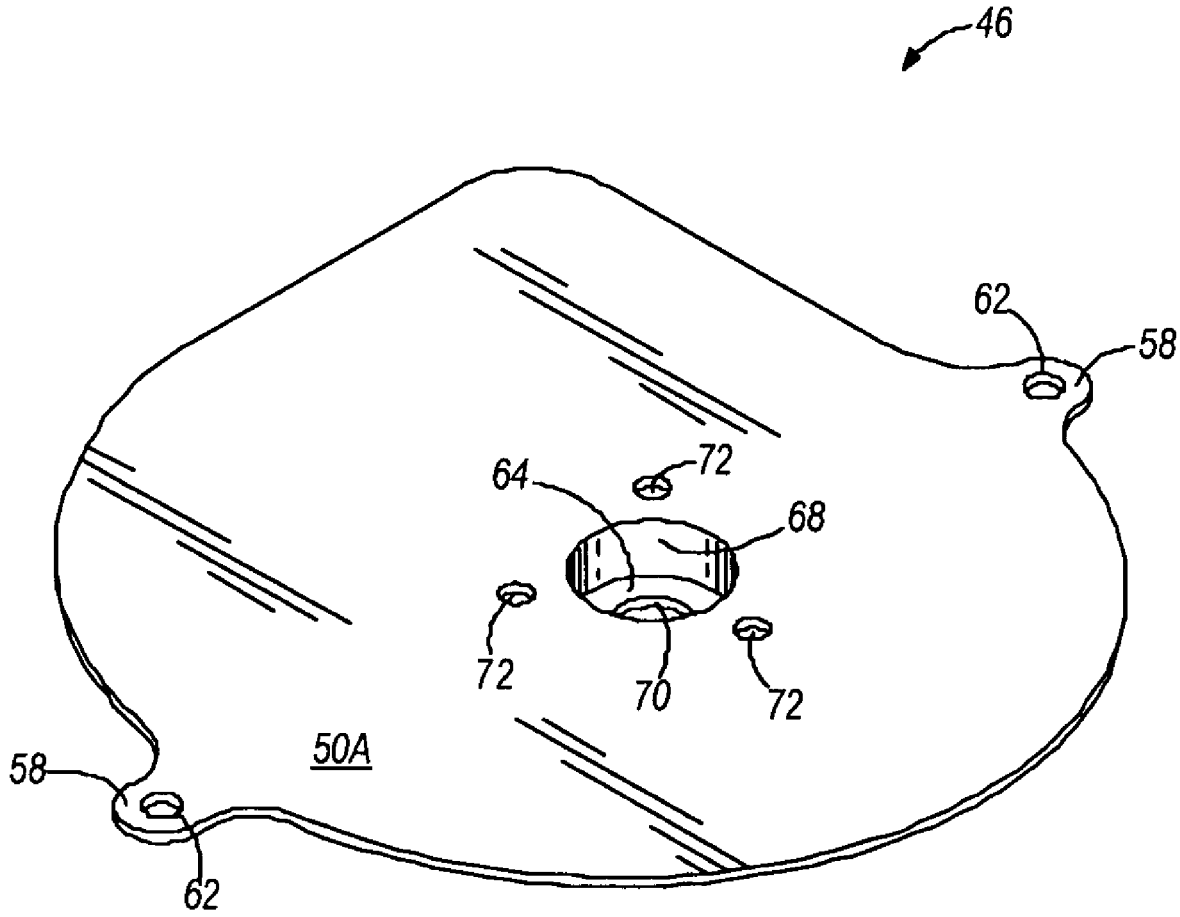
FIG. 6 is a perspective view of a plate according to one embodiment of the invention.
Figure 8:
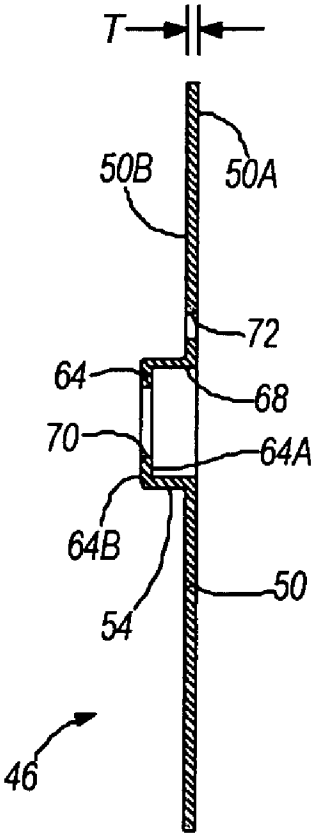
FIG. 8 is a section view of the plate of FIG. 6 taken along line A-A (shown in FIG. 7).
Figure 7:
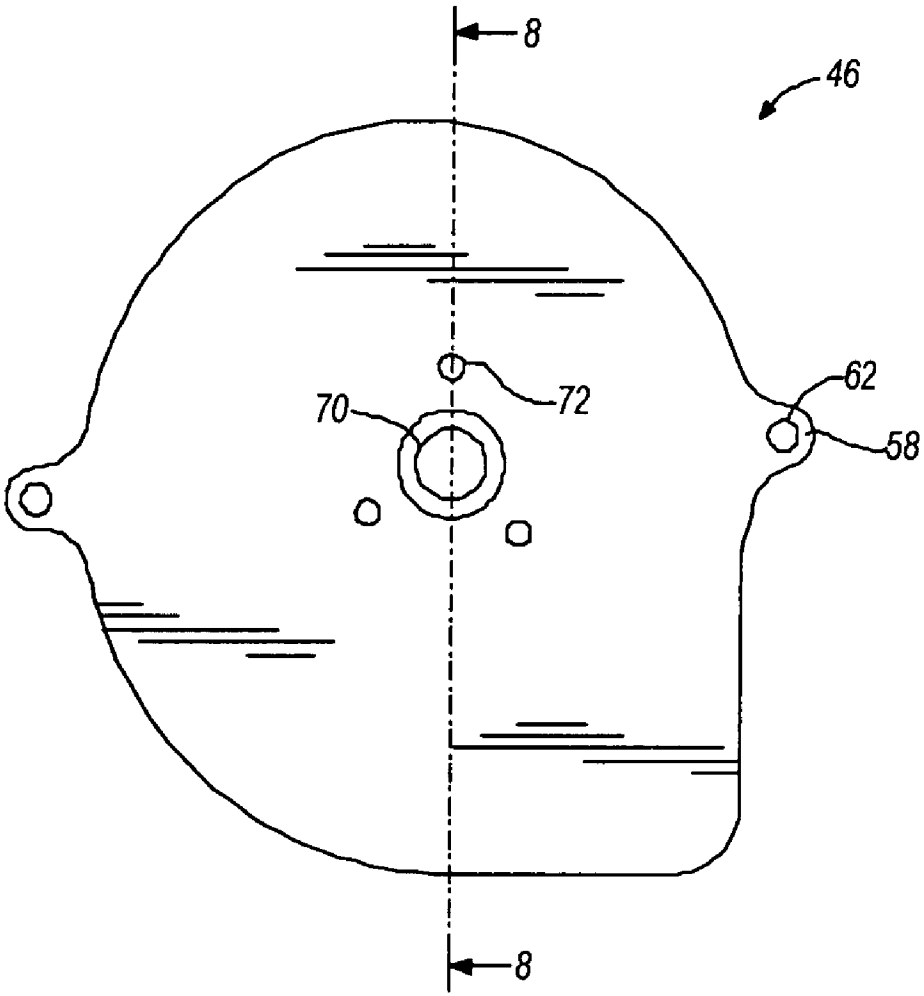
FIG. 7 is a top view of the plate of FIG. 6.

FIG. 5 is a section view of the pump 10 through the recessed wall 64 of the plate 46, along line B-B of FIG. 3. The impeller shroud 38 can include mounting ears 94 and mounting holes 96, which can be aligned with corresponding threaded bores in the body 34A. Screws 98 can secure the impeller shroud 38 to the body 34A. A flow director 100 can be positioned between the impeller shroud 38 and the plate 46 to direct flow from the pumping chamber to the fluid outlet 18.

During operation, the motor 22 can drive the driveshaft 30 and the impeller 26. The pump 10 can be partially submersed in working fluid. As the impeller 26 rotates, the impeller 26 creates a pressure differential, drawing working fluid into the pumping chamber through the pumping chamber inlet 38A and forcing working fluid out of the fluid outlet 18. The motor 22 generates heat as it operates. Heat generation is due at least partially to the electric current in the motor 22 and the small amount of friction present in the bearings 22D and shaft seals 42. Heat generation may be influenced by any of the following: rotational speed of the driveshaft 30, torque load on the motor 22 due to friction (including that present between the working fluid and the impeller 26), and time of continuous operation.

The planar portion 50 of the plate 46 can provide a large amount of surface area that thermally connects the motor housing 22C to the working fluid within the pumping chamber. This creates a heat dissipation circuit, in which heat energy is conducted from the motor housing 22C through the plate 46 and then conveyed to the working fluid by forced convection. In one embodiment, the plate 46 can be constructed to minimize the thickness T of the planar portion 50 to provide minimum resistance to heat conduction without sacrificing the strength necessary to mount the motor 22 in a stable manner within the pump 10. In one embodiment, the plate 46 can be constructed of stainless steel, where the thickness T is about 0.05 inches to provide the balance between strength and the conduction heat coefficient through the thickness T. Stainless steel has suitable corrosion resistance characteristics (especially those grades in the 300 series), which is often a factor when substantially unfiltered salt water is the working fluid in the pump. In some embodiments, copper or other heat conductive metals or metal alloys can be used for the material of the plate 46. In one embodiment, the plate 46 has about a 3 inch diameter. The diameter of the plate 46 can correspond to the size of the motor 22. For example, a 1 inch motor can be coupled to a 1 inch diameter plate 46. The diameter of the plate 46 can increase or decrease generally according to the size of the motor 22.

In some embodiments, the impeller 26 can be constructed with a planar upper portion 26A (transverse to the driveshaft 30) and impeller blades 26B, which can extend down from the planar upper portion 26A. As opposed to impeller blades which extend directly from a driveshaft, the impeller blades 26B can provide more concentrated pumping action in a radially outward direction. The planar upper portion 26A can limit stray pumping action in the longitudinal direction (parallel to driveshaft 30), and consequently, can affect the flow characteristics of the working fluid above the planar upper portion 26A. In some embodiments, the pump 10 is a high flow pump, and the planar upper portion 26A of the impeller 26 affords greater heat transfer capacity between the working fluid and the plate 46 by increasing the convection heat transfer coefficient. In some embodiments, the impeller 26 creates turbulent flow to increase the heat transfer capacity between the working fluid and the plate 46. In some embodiments, the impeller 26 does not include a planar upper portion 26A.

Thus, the invention provides, among other things, a pump with simple, effective cooling means for the internal motor. Various features and advantages of the invention are set forth in the following claims.

The invention claimed is:

1. A pump for pumping a working fluid, the pump comprising:

a pump housing defining a fluid inlet and a fluid outlet, the fluid inlet and the fluid outlet communicating with a pumping chamber;

an impeller positioned within the pumping chamber;

a motor with a rotary output shaft coupled to the impeller, the motor positioned within a motor chamber that is sealed from the working fluid in the pumping chamber; and a plate at least partially constructed of a heat conductive material, the plate at least partially defining the pumping chamber, the plate transferring heat from the motor to the working fluid in the pumping chamber, the plate forming at least part of a fluid tight seal between the motor chamber and the pumping chamber.

2. The pump of claim 1, wherein the plate is constructed of at least one of stainless steel and copper.

3. The pump of claim 1, wherein the pump housing is constructed of plastic.

4. The pump of claim 1, wherein the impeller is constructed of plastic.

5. The pump of claim 1, wherein the impeller includes a substantially planar upper portion transverse to the output shaft, the substantially planar upper portion having a plurality of downwardly extending impeller blades.

6. The pump of claim 5, wherein the impeller induces turbulence to provide an increased convection heat transfer coefficient between the working fluid and the plate.

7. The pump of claim 1, wherein the plate has a thickness of about 0.05 inches.

8. The pump of claim 1, wherein the pump housing includes a removable base portion having a plurality of openings defining the fluid inlet.

9. The pump of claim 1, wherein the pumping chamber is at least partially defined by an impeller shroud.

10. The pump of claim 9, wherein the impeller shroud includes a tubular portion defining the fluid outlet.

11. The pump of claim 9, wherein the impeller shroud is coupled to one of the pump housing and the plate, the impeller shroud including at least one pumping chamber inlet.

12. The pump of claim 9, wherein the impeller shroud is constructed of plastic.

13. The pump of claim 10, wherein the fluid outlet extends from the impeller shroud substantially tangentially to the impeller.

14. The pump of claim 9, wherein a gasket is coupled between the impeller shroud and the plate.

15. The pump of claim 1, wherein the plate is a motor mounting plate, the plate coupling the motor to the pump housing.

16. The pump of claim 15, wherein the motor is coupled to the plate at a central portion of the plate and the plate is coupled to the pump housing at a peripheral portion of the plate.

17. The pump of claim 1, wherein the plate includes a seal retaining bore and a driveshaft bore, the seal retaining bore retaining a shaft seal on the rotary output shaft, the rotary output shaft passing through the driveshaft bore in the plate.

18. A heat conductive device for use in a pump including a pump housing, a fluid inlet, a fluid outlet, a pumping chamber in fluid communication with both the fluid inlet and the fluid outlet, and a motor for pumping a working fluid, the motor positioned within a motor chamber that is sealed from the working fluid in the pumping chamber, the heat conductive device comprising:

a plate at least partially constructed of a heat conductive material, the plate at least partially defining the pumping chamber, the plate transferring heat from the motor to the working fluid in the pumping chamber, the plate forming at least part of a fluid tight seal between the motor chamber and the pumping chamber.

19. The pump of claim 18, wherein the motor is an electric motor.

20. The pump of claim 19, wherein the electric motor is one of a 12 Volt, 24 Volt, and 32 Volt direct current motor.

21. The pump of claim 18, further comprising an impeller coupled to a driveshaft of the motor.

22. The pump of claim 18, wherein the plate is at least partially constructed of at least one of stainless steel and copper.

23. The pump of claim 22, wherein the plate has a thickness of about 0.05 inches.

24. The pump of claim 18, further comprising an impeller shroud at least partially defining the pumping chamber, the impeller shroud including a pumping chamber inlet and a pumping chamber outlet.

25. The pump of claim 18, wherein the pump housing includes a removable base portion having a plurality of openings defining the fluid inlet.

26. The pump of claim 18, wherein the plate is a motor mounting plate, the plate coupling the motor to the pump housing.

27. A method of removing heat from a motor in a pump for pumping a working fluid, the method comprising:

pumping the working fluid through a pumping chamber with a rotating impeller;

forming a fluid tight seal with at least part of a plate positioned between a motor chamber including the motor and the pumping chamber including the working fluid;

conducting heat from the motor to the plate; and transferring heat from the plate to the working fluid in the pumping chamber.

28. The method of claim 27, wherein the plate couples the motor to a pump housing.

29. The method of claim 27, wherein the plate at least partially defines the pumping chamber and the plate transfers heat to the working fluid by forced convection of the working fluid.

30. The method of claim 29, wherein the impeller induces turbulence within the pumping chamber which increases the convection heat transfer coefficient between the working fluid and the plate.

* * * * *